United States Patent [19]

Lutz

[11] Patent Number: 4,909,704

[45] Date of Patent: Mar. 20, 1990

[54] BARREL PUMP

[75] Inventor: Karl Lutz, Wertheim, Fed. Rep. of Germany

[73] Assignee: Firma Karl Lutz, Fed. Rep. of Germany

[21] Appl. No.: 166,720

[22] Filed: Mar. 11, 1988

[30] Foreign Application Priority Data

Mar. 16, 1987 [DE] Fed. Rep. of Germany ..... 3708496
Jun. 1, 1987 [DE] Fed. Rep. of Germany ..... 3718325

[51] Int. Cl.[4] ..... F04D 29/60; F04D 29/52
[52] U.S. Cl. ..... 415/157; 417/411
[58] Field of Search ..... 415/126, 127, 128, 157, 415/158, 171, 219 C, 121 G; 417/411

[56] References Cited

U.S. PATENT DOCUMENTS

| | | | |
|---|---|---|---|
| 3,893,785 | 7/1975 | Maron | 415/157 |
| 3,973,868 | 8/1976 | Weisser | 415/158 X |
| 4,289,457 | 9/1981 | Porter | 415/157 X |
| 4,530,641 | 7/1985 | Gschwender | 415/170 R |
| 4,668,166 | 5/1987 | Lutz | 415/219 C |

FOREIGN PATENT DOCUMENTS

| | | | |
|---|---|---|---|
| 2354369 | 5/1974 | Fed. Rep. of Germany | 417/411 |
| 744355 | 4/1933 | France | 417/411 |

*Primary Examiner*—Robert E. Garrett
*Assistant Examiner*—Hoang Nguyen
*Attorney, Agent, or Firm*—Darby & Darby

[57] ABSTRACT

The barrel pump has at the lower end of its housing wall a sliding sleeve which—in the open position—exposes the inlet openings at the lower end of the housing wall and—in the closed position—in which it rests against a base plate, closes these inlet openings. The base plate projects in the radial direction beyond the housing wall and, consequently, closes the pump from below. Penetration by the liquid can, hence, only occur through the inlet openings provided on the periphery of the housing wall of the pump. Displacement of the sliding sleeve takes place in that at the underside of the sliding sleeve pressure pieces are provided, which in the close position project beyond the base plate downward and upon the pump being placed down due to the weight of the pump acting downward are displaced upward against the action of a spring acting on the sliding sleeve which frees the sliding sleeve from its sealing contact on the base plate and, consequently, permits entrance of the liquid through the inlet openings. When the pump is lifted, the sliding sleeve is pushed again into its closed position by the spring. Manipulating the sliding sleeve can also take place manually with the manipulating device.

7 Claims, 5 Drawing Sheets

Fig. 5
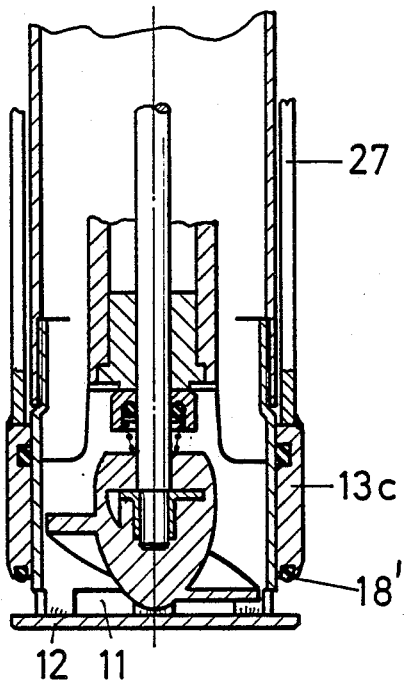
Fig. 6
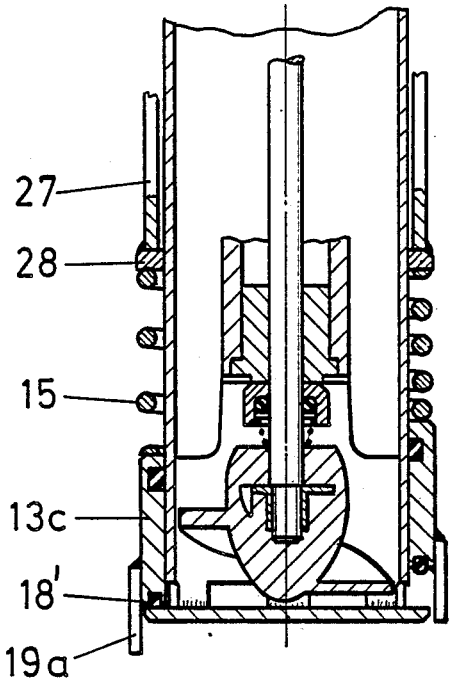
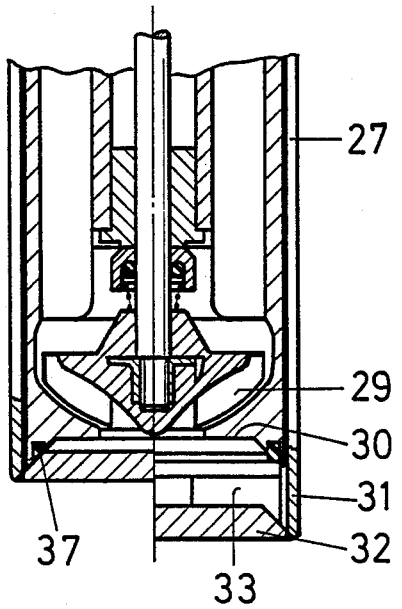
Fig. 7
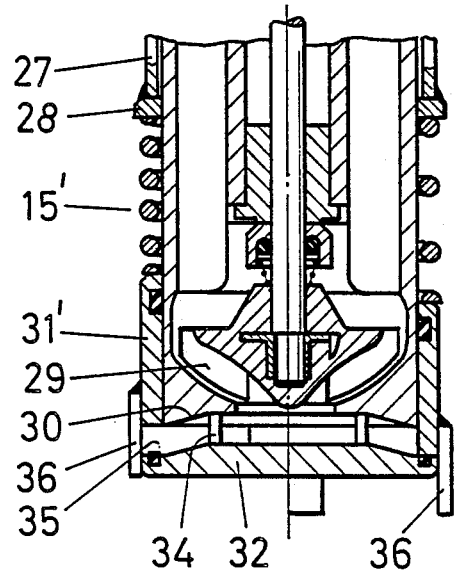
Fig. 8

BARREL PUMP

FIELD OF THE INVENTION

The invention relates to a barrel pump with a pump U rotor driven by a motor over a rotor shaft, with which the liquid in an annular channel between a supporting pipe for the rotor shaft ad a tubular housing wall is pumped up to an outflow connected with these, with the liquid being drawable through inlet openings at the lower end of the housing wall.

BACKGROUND OF THE PRIOR ART

In barrel pumps of this nature (DE-PS No. 34 12 873), two problems arise, especially if environmentally harmful liquids are involved. One problem consists in that moving the pump from one barrel into another with the motor running is not possible, because the liquid runs out of the pump at its lower open end. Such change is necessary if very rapid emptying of several barrels is required. The second problem consists in that the barrels cannot be emptied completely and, due to the inlet openings being arranged at a distance from its lower end, an amount of residual liquid corresponding to the distance of the openings to the end of the housing wall remains in the barrel. To this residual quantity is added the amount of liquid still present in the pump, which upon turning off the motor runs back into the barrel. The thus remaining residual quantity impairs recycling of the barrels.

It is the goal of the invention to reduce the residual quantity remaining in the barrel to a minimum amount.

SUMMARY OF THE INVENTION

Through the design according to the invention, the problem stated above is solved, because, through the fact that the lower pump end can be completely closed off with the base plate and the sliding sleeve, it is avoided that the liquid runs out of the pump completely. This, on the other hand, permit changing the pump even with the motor running, and, on the other hand, by the absence of the quantity running back, the residual amount in the barrel compared to pumps known until now is reduced, or, trough a particularly preferred form described below, completely avoided.

A further advantageous form of the invention is such that the inlet openings are provided immediately above the base plate. This permits even the very last residue of liquid to be withdrawn from the barrel, since the base plate can be relatively thin or—at least at its outer edges—is faceted and, hence, can be made very thin.

In a further model of the invention the sliding sleeve can be displaced by a spring braced against a stationary part of the pump into the closed position and through the weight of the pump upon being set on the barrel bottom into the open position. Thereby, without additional manual operation, opening and closing of the pump inlet is brought about, and, in particular, opening takes place through the weight of the pump against the spring action, while the spring shifts the sliding sleeve when the pump is lifted and in so doing closes the pump. The quantity of liquid remaining in the pump, consequently, can neither run back into the barrel nor harm the environment when the pump is moved into another barrel.

A particularly advantageous model results according to the invention in that the base plate is fastened on the housing wall and the base plate projects beyond the housing wall in the radial direction, that the inlet openings are provided in the housing wall immediately at its lower end directly above the base plate, that the sliding sleeve can be pressed with its lower end forming a seal against the base plate, and that at the sliding sleeve pressure pieces are provided projecting downward beyond the base plate in the closed position, which in the completely open position of the sliding sleeve are flush with the underside of the base plate and the length of which projecting in the closed position beyond the base plate essentially corresponds to the height of the inlet openings. This design offers not only the advantage that the liquid contained in the pump remains in it, but the additional prominent advantage is such that the suction opening is immediately in the vicinity of the bottom, and specifically directly above the base plate, which can be constructed relatively thin so that a liquid layer only a few millimeters high remains in the barrel.

A constructionally simple solution results according to the invention in that the spring surrounding the housing wall is braced, on the one hand, at a flange arranged on the housing wall and, on the other, at the upper edge of the sliding sleeve.

According to another design of the invention, the sliding sleeve can be displaceable from above with a manipulation device projecting from the barrel, with this manipulation device being able to be used alone or in connection with the spring explained above, so that the automatic activation brought about by the spring can be additionally influenced by manual operation.

If the issue is primarily a particularly rugged model, with which changing the pump with the motor running is possible and the residual amount is of only secondary importance, the sliding sleeve can be provided with inlet openings at a distance to its lower edge distributed on the periphery and above the inlet openings an inner shoulder, which rests forming a sealing in the closed position against the base plate, which projects beyond the housing wall. This leaves a closed annular wall at the lower end of the sliding sleeve, with which even when the sliding sleeve is placed hard on the barrel bottom damage is practically impossible. This pump is therefore suitable for such applications, in which the primary issue is very rapid emptying of several barrels with the pump motor running and not so much the remaining residual quantity, which, due to the ring of the sliding sleeve below the inlet openings is greater in the possible design explained above.

A modified embodiment, which is even more rugged, is provided by an arrangement, in which the sleeve has at its lower end an inner flange or bottom for supporting the spring, which is braced with its other end against the underside of the base plate, and that openings are provided on the periphery of the sliding sleeve in its lower part inlet. The bottom of this sliding sleeve can be built particularly ruggedly and, in addition, the spring is arranged so as to be protected, so that here too no damage can occur.

So that the inlet openings in the sliding sleeve and those in the housing wall are always aligned with each other, it is advantageous to hold the sliding sleeve torsion-tight relative to the housing wall, for example, by a pin engaging a groove.

A particularly preferred embodiment of the barrel pump, which permits practically complete emptying of a barrel, is characterized in that the lower end of the housing wall having the inlet openings below the pump rotor at a distance to it tapers nozzle-like with an overall included angle of less than 180° and is connected with the base plate, which has a smaller diameter than the housing wall, and is connected forming seal except for the inlet openings, that the inlet openings are provided in the tapering part, that the sliding sleeve is guided inside of the housing wall and sealed against it and tapers in its lower region nozzle-like, that the outlet of the sliding sleeve can rest against the base plate forming a sealing, with the inlet openings in the housing wall being provided radially outside the outlet of the sliding sleeve, and that the sliding sleeve is displaceable from above through a manipulation arrangement projecting from the barrel.

Through this design several advantages compared to the previously described models are achieved. By arranging the sliding sleeve within the housing wall, an enlargement of the diameter is avoided, so that the pump can also be inserted into narrow withdrawal openings like the previously known barrel pumps. In addition, all parts functioning to close the pump inlet are located within the housing wall, which protects them. Damage through rough handling of the pump to the sliding sleeve, its sealing, and the operating parts provided for it, therefore, is impossible. The most important advantage consists in that the inlet openings are in the tapering part and consequently, when the pump is set into the barrel, are in the immediate vicinity of the barrel, so that the barrel can be practically completely emptied.

The tapering part of the housing wall can conveniently be formed as a flat truncated cone or as spherical cap.

When using a radial rotor, a particular advantage is obtained with the tapering design of the sliding sleeve, which consists in that the lower tapering part of the sliding sleeve is adapted in the manner of a wear ring to the shape of the radial rotor, so that particularly favorable run-in conditions for the rotor obtain. This occurs since the outlet of the sliding sleeve is in the vicinity of the inlet openings and at a slight distance from the base plate, so that a particularly strong suction effect on the liquid penetrating the inlet openings results. Due to its slideability, the sliding sleeve can be slid close to the base plate when only a slight residual quantity is present in the barrel, so that only a slight gap between the sliding sleeve and the base plate obtains, which leads to a particularly strong suction effect on the residual amount.

A particularly advantageous design with respect to ease of operation of the sliding sleeve results in that two thrust webs are fastened at the sliding sleeve, which are connected with the supporting pipe, which is guided displaceably and forming a seal in a bearing support (bearing star) arranged above the pump rotor as well as in a friction bearing above the outflow and connected at its end projecting beyond the friction bearing with a handle reaching through an opening in the housing wall, and that the opening in the housing wall is fashioned as a slit extending obliquely to the longitudinal axis of the pump and is arranged above the friction bearing. Due to this design only the additional thrust webs are required for shifting the sliding sleeve, because the supporting pipe functions simultaneously also as organ of transfer of the displacement motion introduced by the handle. With the pump in the vertical position, the slit, in which the handle is held, extends at a low angle to the horizontal, by which, upon a motion of the handle within the slit, which extends preferentially approximately over 120° of the housing wall, a rotational motion and, due to the slit obliquity, a vertical motion of the supporting pipe is generated. This transfers this raising and lowering motion over the thrust webs to the sliding sleeve. In a preferred embodiment, the slit obliquity is in connection with the slit length so chosen that a displacement path of the sliding sleeve of approximately 6 mm results. Hereby, the distance of the outlet of the sliding sleeve to the base plate and, hence, the inlet cross section to the rotor can be varied particularly sensitively.

In an advantageous further development of the invention, the thrust webs through the free spaces in the bearing support (bearing star) are arranged reaching through it and radially to the pump axis and fastened at its ends facing away from the sliding sleeve with a hub slidable onto the supporting pipe, which, in turn, is detachably fastened on the supporting pipe, for example, through locking rings. The thrust webs assume, due to this radial arrangement in addition to the bearing support (bearing star), a compensating effect on the liquid set into circulating motion through the rotor, so that a largely calmed axial flow of the liquid within the annular channel is achieved. The free spaces in the bearing support are built so large, that they permit the motion of the thrust webs around the rotor axis generated by the handle. By using a hub, which can be slid onto the supporting pipe and fastened detachably by locking rings, not only simple installation and removal is made possible but, if necessary, also simple retrofitting of existing pumps.

In order to prevent the liquid from rising along the supporting pipe up to the bearing of the rotor shaft in spite of the arrangement of operating elements for the sliding sleeve, the friction bearing is held conveniently by a partitioning wall closing off the annular channel.

If, in further development of the invention, the lower part of the housing wall, which serves to receive the sliding sleeve, is fashioned as a removable cap, then not only simple installation of the pump is made possible hereby but this cap, functioning as pump foot, which to a particular extent is subjected to impact during inserting and setting down the pump, can—in this manner—be built as a particularly rugged constructional part with a greater wall thickness than the remaining housing wall.

This design—reinforced relative to the housing wall—offers the precondition for advantageous model, which consists in that the seal for sealing the sliding sleeve against the housing wall is set into the inner wall of the cap. This allows that the sliding sleeve can be build thin-walled, since it does not need to receive a seal, which can be set into the wall of the cap, which for reasons of protection is thicker anyhow.

Preferentially, the base plate has arranged on it a seal, with which the sliding sleeve in its closed position cooperates. It would, of course, also be possible to do without the seal, if the base plate and the sliding sleeve are fitted precisely to each other. The seal, however, avoids this additional processing expense and, due to its resiliency, permits reliable sealing even if accidentally small solid particles should become deposited between sliding sleeve and base plate.

If, according to a further advantageous model, the sealing is fashioned as a disk with central slit, through which, when installed, a web fastened on the base plate extends, then twisting of the seal or shifting of it due to the rotational motion of the sliding sleeve is avoided.

As far as the invention is concerned, it is basically insignificant at which site the sealing between housing wall and sliding sleeve takes place. If the sealing of the sliding sleeve against the housing wall is provided near the outlet it is advisable for the sliding sleeve to replace the housing wall below the sealing area toward the inlet openings because otherwise the condition might arise that the housing wall and the sliding sleeve would extend together over a large distance of the pump which would lead to an unnecessary accumulation of materials. The housing wall and the sliding sleeve would extend parallel to each other over a large part of the length of the pump without this bringing about any advantageous results. Rather, the parallel arrangement of the housing wall and the sliding sleeve would cause an unnecessary increase in weight. For this reason the sliding sleeve can replace the housing wall below the sealing area.

For a better understanding of the present invention, reference is made to the following description and accompanying drawings, while the scope of the invention will be presented in the appended claims.

BRIEF DESCRIPTION OF THE DRAWINGS

In the drawings,

FIG. 2 to FIG. 8 are sectional representations of the lower part of different designs of barrel pumps;

DESCRIPTION OF THE PREFERRED EMBODIMENT

Figure 1:
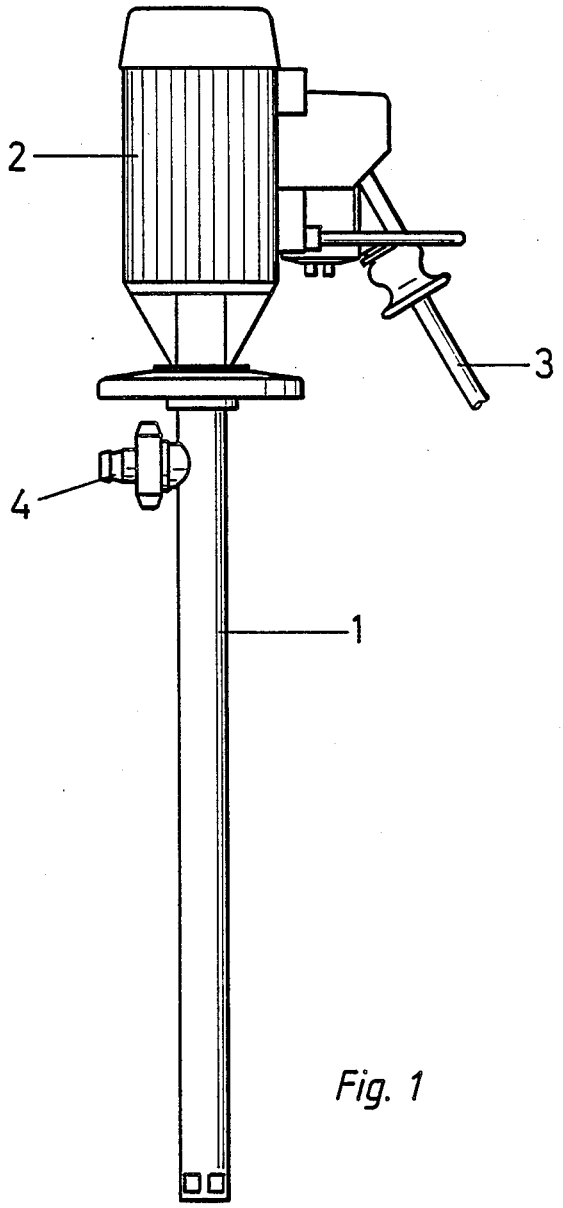
FIG. 1 shows a general view of a barrel pump.

FIG. 1 shows a barrel pump with tubular pump body 1 and a drive motor 2 built as electromotor, the connecting line of which is labeled 3. Element 4 designates the outflow of the pump to which, for example, a hose with dispensing pistol is connectable. The pump is intended for transporting liquid out of barrels, with the tubular pump body 1 having an outer diameter, which permits introducing the pump into the customarily provided bungholes.

All lower pump sections shown in FIGS. 2 to 8 have a tubular housing wall 5 and a supporting pipe 6 for a rotor shaft 7, with an annular channel remaining between housing wall 5 and supporting pipe 6, in which liquid can be transported with a pump rotor 9 to outflow 4. The pump rotor 9 is connected with the rotor shaft 7. Element 10 refers to a bearing for the rotor shaft 7. At the lower end of the housing wall 5 are located inlet openings 11, through which the liquid reaches the pump rotor 9. In all models, with the exception of those according to FIG. 7 and 8, a base plate is provided at the lower end of the housing wall 5, which is firmly connected with the housing wall 5.

Figure 2:
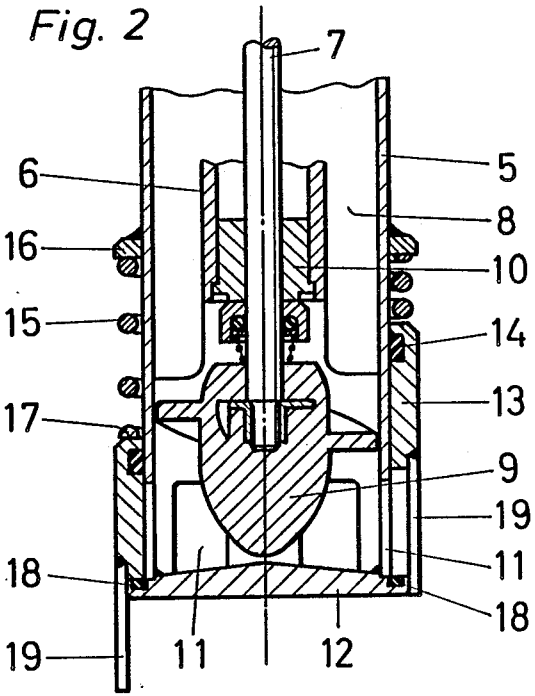

In the embodiment according to FIG. 2 at the lower end of the housing wall on the outer circumference, a sliding sleeve 13 is provided, which is sealed with a seal 1 against the housing wall 5. The sliding sleeve 13 is spring loaded with spring 15, which, in turn, is braced against a flange 16 fastened on the housing wall 5 and the upper front face 17 of the sliding sleeve 13. The spring 15 pushes the sliding sleeve 13 into its closed position, which is shown in the left half of FIG. 2. In the process, the sliding sleeve 13 is pushed against a seal 18 in the base plate 12. The inlet openings 11 are, hence closed, which prevents any liquid from running out of the pump, since the pump inlet, namely the inlet openings 11 and the end of the housing wall 5 open in known pumps in closed by the sliding sleeve 13 and the base plate 12. At the lower front face of the sliding sleeve 13, several pressure pieces !9 are arranged, which permit, upon the pump being set on the barrel bottom, a displacement of the pump against the action of the spring 15 downward until the base plate 12 also sits o the barrel bottom. In this position, the lower end of pressure piece 19 is aligned with the underside of the base plate 12, as is shown in the right-hand side of FIG. 2. Through the sliding sleeve 13, displaced upward by, the liquid can reach the inlet openings 11 between the discrete pressure pieces 19, after which it can be pumped up by the pump rotor 9. When the pump is lifted, due to the absent pump weight, the sliding sleeve !3 is brought by the spring 15 into its closed position.

This design permits barrel change even with the motor running, since, on lifting the pump, the pump inlet is closed through the sliding sleeve 13. As soon as the pump sits on the barrel bottom, the inlet openings are again opened. Since the inlet openings 11 are located at the lower end of the housing wall 5, hence, immediately above the base plate 12, the barrel can be emptied down to an exceedingly slight residual quantity. The pressure pieces 19 project in the closed position of the sliding sleeve 13 so far downward beyond the base plate, that, upon setting the pump onto a barrel bottom, the sliding sleeve is displaced corresponding to the height of the inlet openings. With low inlet openings and a thin base plate 12, the remaining level of liquid is only a few millimeters.

In the succeeding models, identical parts are designated by the same reference numbers and technically corresponding parts with the same reference numbers, however, with an additional line or letter.

Figure 3:
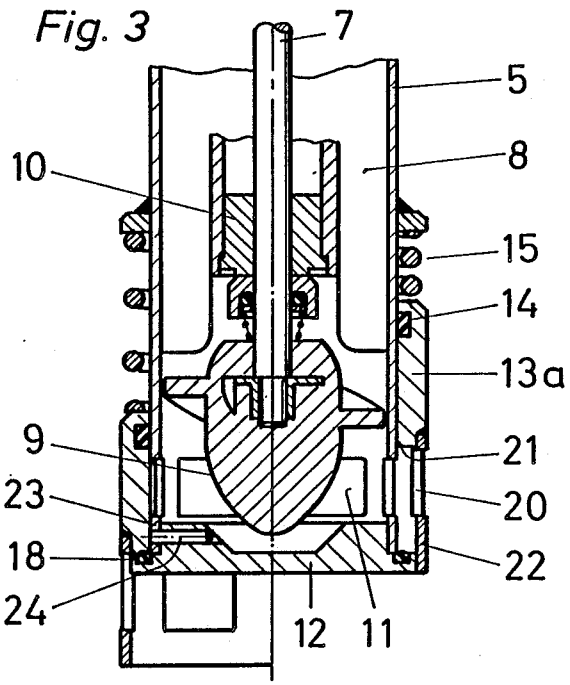

The modification of the model according to FIG. 3 compared to that according to FIG. 2 consists in that the sliding sleeve **13*a* comprises an upper closed part and a lower part provided with inlet openings 20, between which an inner shoulder 21 is formed, which in the closed position pushes against the seal 18. This is shown if FIG. 3 in the left half, while the right half shows the open position. This model—due to the lower closed ring 22 of the sliding sleeve 13 is less sensitive to being set downward on the barrel bottom—leaves, however, a greater residual quantity due to the height of ring 22**.

So that the inlet openings 11 of the housing wall 5 and the inlet openings 20 of the sliding sleeve 13 are aligned with each other in the open position, a groove 23 is provided on the inside of the sliding sleeve **13*a*, which a guide pin 24** located on the base plate engages.

Figure 4:
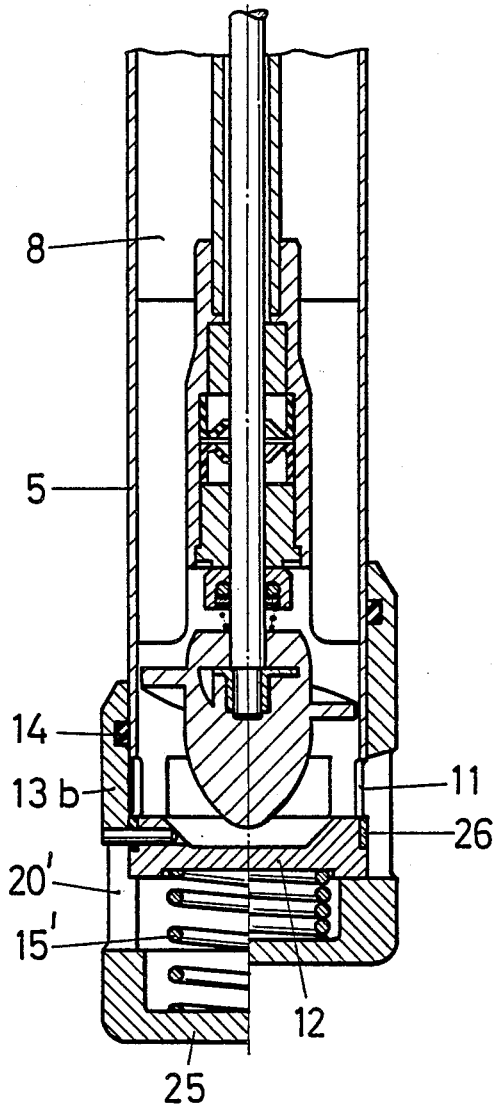

In the embodiment according to FIG. 4, the sliding sleeve **13*b* is provided with a closed bottom 25, against which a spring 15' is braced, the other end of which lies against the underside of the base plate 12. The left half of FIG. 4, the closed position of the sliding sleeve 13*b* is shown, which is pushed by spring 15' so far upward that the inlet openings 20' lie below the upper edge of the base plate 12. In the upper area of the base plate, it is provided with a seal 26, so that liquid from the annular space 8 of the pump cannot run down and out. By setting the pump on a barrel bottom, the sliding sleeve 13*b* is displaced upward against the action of spring 15', so that the inlet openings 20' of the sliding sleeve 13*b* are at least partially aligned with the inlet openings 11 of the housing wall 5**. This model, due to the ruggedness of the bottom of the sliding sleeve, is especially insensitive to hard impact.

In the embodiment according to FIG. 5, the sliding sleeve **13*c*, essentially comparable to the sliding sleeve 1 according to FIG. 2, does however, not have any pressure pieces projecting downward, which function in the model according to FIG. 2 is to displace the sliding sleeve into its open position. In this embodiment 1 shown in FIG. 5, the displacement of the sliding sleeve 13*c* takes place with a manipulation device 27, which is firmly connected with the sliding sleeve 13*c* and projects upward from the barrel. This manipulation service 27 can be a piece of pipe which upon rotation is longitudinally displaced by coarse threads. At the upper end of this tubular piece of the manipulation device, a hand wheel or a lever can be arranged. The sliding sleeve 13*c* is provided on its lower front fact with seal 18', which rests on the base plate 12 in the lower position. In this model relatively low inlet openings 11 are provided, so that in connection with the thin base plate 12**, a small residual quantity is left in the barrel after the pumping process has been completed.

The design according to FIG. 6 shows a modification compared to that according to FIG. 5, which consists in that pressure pieces **19*a* are provided on the sliding sleeve 13*c*, which have the same function as the pressure pieces 19 in the model according to FIG. 2. The modification compared to FIG. 5 consists additionally in that the manipulation device 27 is connected with a pressure ring 28 of spring 15 and, consequently, the sliding sleeve 13*c* cannot displace it directly but displaces it by initially acting upon the pressure ring 28 and by way of the spring 15, which is connected with the pressure ring 28 as well as with the sliding sleeve 13*c*. In this design the different possibilities of displacing the sliding sleeve according to FIG. 2 are combined with those according to FIG. 5, i.e. the sliding sleeve can by being set of the barrel floor be opened with the pressure pieces 19*a* against the action of the spring 15 or the sliding sleeve can be lifted into the open position with the manipulation device 27 and also can be displaced again into the closed position. As long as the pressure ring 28 is being held in the position indicated in FIG. 6 by the manipulation device 27, closing of the pump inlet takes place due to the spring action of spring 15**.

In the embodiment according to FIGS. 7 and 8, in contrast to the models described up to this point, in which axial wheels are provided as pump rotors, radial wheels 29 are provide. Accordingly, the inflow is designed differently, and, in particular, a wear ring 30 is assigned to the radial wheel 29, so that the liquid essentially is sucked into the pump in the region of the center of the pump rotor.

In the embodiment according to FIG. 7, a sliding sleeve 31 is connected firmly and sealingly with a base plate 32 fashioned as bottom and displaced with a manipulation device 27 into the open position shown in the right half of FIG. 7 or into the closed position shown in the left half of FIG. 7. In the lower area of the sliding sleeve 31, the inlet openings 33 are provided, through which—when the sliding sleeve 31, is lowered downward—liquid can penetrate into the central region of the pump rotor 29. In the closed position, the base plate 32 rests against a seal 37 set into the wear ring 30.

The design according to FIG. 8 makes use of the principles shown in FIGS. 2 and 6 with respect to the displacement of the sliding sleeve. Here, the base plate 32 is held with spacer 34 at a given distance to the wear ring 30, so that, between wear ring 30 and base plate 32, an inlet gap 35 remains, through which liquid can penetrate to the inlet opening of the wear rings when the sliding sleeve 31' is pushed upward against the action of spring 15'. In order to make such displacement possible, pressure pieces 36 corresponding to the pressure pieces 19 and 19' in FIGS. 2 and 6 are arranged on the underside of the sliding sleeve 31. Spring 15' supports itself against a pressure ring 28', which can be displaced with a manipulation arrangement 27 as in the design according to FIG. 6, so that, apart from the displacement possibility due to the pump weight and the spring action, a voluntary displacement possibility through the manipulation device 27 is provided.

Figure 9:
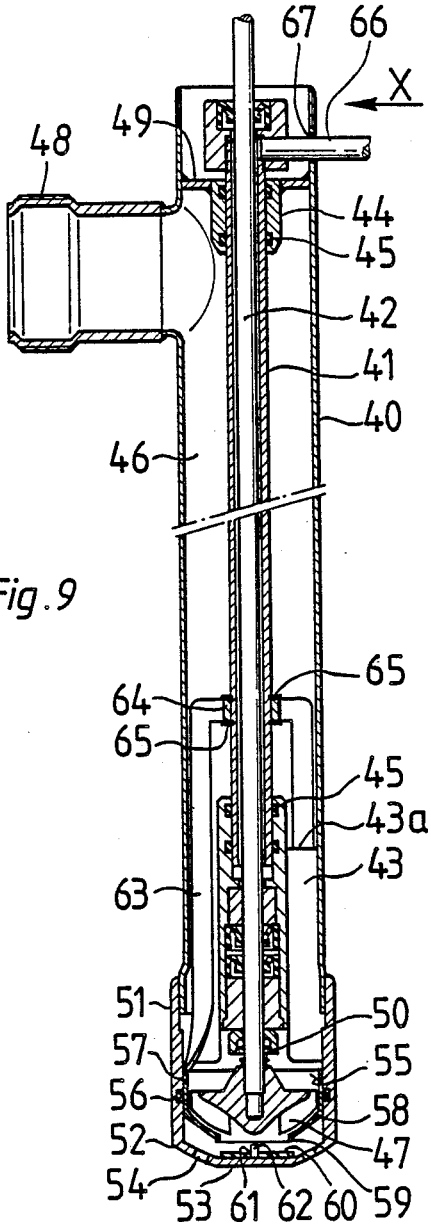
FIG. 9 illustrates a longitudinal section through a barrel pump of a further model.
Figure 10:
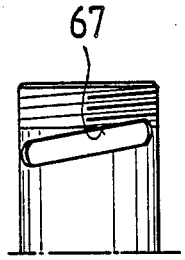
FIG. 10 is a view in the direction of arrow X in FIG. 9.

FIGS. 9 and 10 show a particularly preferred model. Regarding the general structure of the pump body and electromotor reference is made to FIG. 1. Within housing wall 40, a supporting pipe 41 for rotor shaft 42 is provided, which at its lower end is held rotatably and longitudinally displaceably in a bearing support (bearing star) 43 and its upper end in a friction bearing 44 sealed by sealing 45.

Between housing wall 40 and the supporting pipe 41, an annular channel 46 is formed, in which the liquid is transported by a pump rotor 47 to an outflow 48, which is located at the upper end of the housing wall 40. Above the outflow 48, a partitioning wall 49 is included, which supports the friction bearing 44, so that the annular channel 46 is sealed toward the top.

The bearing support (bearing star) 43 corresponds to the conventional design of such bearing supports (bearing stars) for barrel pumps and serves to support the supporting pipe 41 and for the support of the rotor shaft 42 as well as for sealing it with a sliding packing ring 50. The bearing support has customarily three to four ribs **43*a* arranged in the shape of star, between which free spaces remain for the liquid transported by the pump rotor 47 to pass through. The star-shaped ribs 43*a*** function not only as support of the bearing body but also for orienting the circulating flow in the axial direction.

The lower part of the housing wall is fashioned as cap 51, which is screwed onto the tubular part 40. The cap 51 functions as pump foot and has a greater wall thickness than the remaining housing wall 40. The cap 51 essentially receives the rotor 47. The cylinder-shaped part of the cap 51 continues into the tapering part 52 which is built as a spherical cap. The bottom of the cap forms a base plate 53, which adjoins the tapering part 52. Directly on the base plate 53 in the tapering part 52 of the cap 51 inlet, openings 54 are provided, through which the rotor 47 draws in the liquid to be transported.

Within the lower part of the housing wall, i.e. within the cap 51, a sliding sleeve 55 is provided, which comprises a cylindrical part 57 sealed by a seal 56 by a seal 56 relative to the housing wall and a nozzle-like tapering part 58 adjoining it in the downward direction, with this tapering part 58 being adapted to the shape of the rotor 47 and serving as a wear ring for the radial rotor 47. With outlet 59 of the nozzle-like taper 58, the sliding sleeve 55 in it lower closed position can be placed against the base plate 53 forming a seal. In order to achieve good sealing, a seal disk 60 is provided on the base plate, which can be paced onto a web 62 fastened on the base plate 53, so that it is protected against twisting.

The base plate 53 is only slightly larger than the diameter of the outlet 59 and, consequently, has a significantly smaller diameter than the housing wall. In the lower closed position not shown in the drawing, the inlet openings 54 are closed, since they are provided outside of the outflow 59 resting against the sealing disk 60, whereby the flowing out of liquid from the pump is prevented. Since the tapering region 52 of cap 51 extends with an overall included angle of less than 180° and the openings 54 directly adjoin the base plate 53, the radial inner regions of the inlet openings 54 lie directly above the barrel bottom so that in the position of the sliding sleeve 55 shown in FIG. 9, the liquid can be pumped completely from a barrel.

The base plate 53, the tapering part 52, and the cylindrical part of the cap 51 are built in one piece.

In order to slide the sliding sleeve 55, it is connected at its upper edge with two thrust webs 63, which extend in the radial direction relative to the rotor axis in the vicinity of the inner wall of the housing wall 40 and reach through the free spaces in the bearing support (bearing star) 43. The upper ends of the thrust webs 63 are connected with hub 64 slidable onto the supporting pipe 41, which can be fixed to the supporting pipe 41 with locking rings 65.

The supporting pipe 41 projects beyond the friction bearing 44 upward and is at its upper end connected with a handle 66, which is developed as bolt, which is guided through a slit 67 in the housing wall 40. The slit 67 extends at an angle to the longitudinal axis of the pump and is—in the vertical position of the pump—inclined at an acute angle to the horizontal. This slit extends approximately over 120° of the housing wall and forms a guide for the handle 66, he motion of which in this slit 67, due to the obliquity compared to the longitudinal axis, is raised or lowered. This motion is transferred to the supporting pipe 41, which transfers this motion to the sliding sleeves 55 by way of the thrust webs 63. In FIG. 9, the sliding sleeve is shown in its completely open position and surrounds the pump rotor 47 with a narrow gap.

For pumping the liquid from a barrel, the handle 66 is rotated so that it is in the upper part of slit 47 which brings the sliding sleeve into the completely open position. When the barrel is pumped out, the handle 66 is moved into the other end position of the slit 47, which displaces the supporting pipe 41 downward, so that by way of the thrust webs 63, the sliding sleeve 55 is moved downward until its outlet 59 rests on the sealing disk 60 forming a seal. In this state, the pump can be taken out of the barrel without the liquid contained in the annular space 46 being able to run out of the pump. The pump can then be set into a small container, to permit the residual quantity contained in the annular channel to run out. This permits complete emptying of the barrel and emptying of the pump.

While the foregoing description and drawings represent the preferred embodiments of the present invention, it will be obvious to those skilled in the art that various changes and modifications may be made therein without departing from the true spirit and scope of the present invention.

I claim:

1. In a barrel pump with a pump rotor driven by a motor by way of a rotor shaft, with which the liquid in an annular channel between a supporting pipe for the rotor shaft and a tubular housing wall is pumped to an outflow connected to it, with the liquid being drawable through an inlet opening at the lower end of the housing wall, the improvement comprising:

a base plate provided below the pump rotor and at a distance to it;

a sliding sleeve forming a seal against the housing wall; and displaceable relative to it, said seal in one position exposing inlet openings and in the other position, in connection with the base plate, closing the pump inlet.

2. A barrel pump as in claim 1, wherein the inlet openings are provided immediately above the base plate.

3. In a barrel pump with a pump rotor driven by a motor by way of a rotor shaft, with which the liquid in an annular channel between a supporting pipe for the rotor shaft and a tubular housing wall is pumped to an outflow connected to it, with the liquid being drawable through an inlet opening at the lower end of the housing wall, the improvement comprising:

a base plate provided below the pump rotor and at a distance to it;

a sliding sleeve forming a seal against the housing wall; and displaceable relative to it, said seal in one position exposing inlet openings and in the other position, in connection with the base plate, closing the pump inlet and wherein the lower end of the housing wall, having the inlet openings below the pump rotor at a distance to it at an angle of inclination of less than 90°, tapers nozzle-like and with the base plate, which has a smaller diameter than the housing wall is connected forming a seal except for the inlet openings, wherein inlet openings are provided in the tapering part, wherein sliding sleeve is held in the interior of the housing wall forming a seal against it and tapers nozzle-like in its lower regions, wherein the outflow of the sliding sleeve is restable against the base plate forming a seal, with the inlet openings being provided radially in the housing wall outside the outlet of the sliding sleeve, and wherein the sliding sleeve is displaceable from above by a manipulation arrangement projecting from the barrel.

4. A barrel pump as in claim 3, wherein the tapering part of the housing wall is formed as a flat truncated cone or spherical cap.

5. A barrel pump as in claim 3, wherein, when using a radial rotor, the lower tapering part of the sliding sleeve is adapted in the manner of a wear ring to the shape of the radial rotor.

6. A barrel pump as in claim 3, wherein, at the sliding sleeve, two thrust webs are fastened, which are connected with the support pipe, which, on the one hand, is held sliding and forming a seal in a bearing support arranged above the pump rotor, and on the other, in a friction bearing above the outlet and connected at its end projecting beyond the friction bearing with a handle reaching through an opening in the housing wall, and wherein opening is formed as a slit extending obliquely to the longitudinal axis of the pump and arranged above the friction bearing.

7. A barrel pump as in claim 6, wherein the thrust webs through the free spaces in the bearing support and reaching through it are arranged radially to the pump axis and fastened at its end facing away from the sliding sleeve with a hub, which can be slid onto the supporting pipe, which, in turn, is detachably fastened on the supporting pipe, with a locking ring.

* * * * *